US007901180B2

(12) United States Patent
Abdel-Messeh et al.

(10) Patent No.: US 7,901,180 B2
(45) Date of Patent: Mar. 8, 2011

(54) ENHANCED TURBINE AIRFOIL COOLING

(75) Inventors: William Abdel-Messeh, Middletown, CT (US); Andrew J. Lutz, Glastonbury, CT (US); Douglas E. Duke, Hebron, CT (US); Jose A. Lopes, Ellington, CT (US); Aaron T. Frost, San Antonio, TX (US); Kevin J. Pallos, South Glastonbury, CT (US); Kenneth J. Sawyer, East Hartford, CT (US); Eric Herbst, Tolland, CT (US); Michael D. Greenberg, Bloomfield, CT (US); Ricardo Trindade, Coventry, CT (US)

(73) Assignee: United Technologies Corporation, Hartford, CT (US)

( * ) Notice: Subject to any disclaimer, the term of this patent is extended or adjusted under 35 U.S.C. 154(b) by 938 days.

(21) Appl. No.: 11/800,597

(22) Filed: May 7, 2007

(65) Prior Publication Data

US 2008/0279695 A1 Nov. 13, 2008

(51) Int. Cl.
*F01D 5/08* (2006.01)
*F01D 5/18* (2006.01)

(52) U.S. Cl. ..... 416/1; 416/97 R; 415/115

(58) Field of Classification Search ..... 415/115, 415/116, 173.1, 173.4; 416/1, 95, 97 R, 416/179, 181

See application file for complete search history.

(56) References Cited

U.S. PATENT DOCUMENTS

| | | | | |
|---|---|---|---|---|
| 5,238,364 | A | 8/1993 | Kreitmeier | |
| 5,413,463 | A | 5/1995 | Chiu et al. | |
| 5,924,843 | A | 7/1999 | Staub et al. | |
| 6,139,269 | A * | 10/2000 | Liang | 416/97 R |
| 6,254,347 | B1 | 7/2001 | Shaw et al. | |
| 6,416,283 | B1 | 7/2002 | Johnson et al. | |
| 6,491,498 | B1 * | 12/2002 | Seleski et al. | 416/191 |
| 6,539,627 | B2 | 4/2003 | Fleck | |
| 6,582,584 | B2 | 6/2003 | Lee et al. | |
| 6,743,350 | B2 | 6/2004 | Lee et al. | |
| 6,805,530 | B1 * | 10/2004 | Urban | 415/173.4 |
| 6,824,360 | B2 | 11/2004 | Fleck | |
| 6,910,864 | B2 | 6/2005 | Tomberg | |
| 6,913,445 | B1 * | 7/2005 | Beddard et al. | 416/192 |
| 6,997,675 | B2 | 2/2006 | Dube et al. | |
| 6,997,679 | B2 | 2/2006 | Beddard et al. | |
| 7,114,916 | B2 | 10/2006 | Dube et al. | |
| 2005/0175453 | A1 * | 8/2005 | Dube et al. | 416/97 R |

* cited by examiner

*Primary Examiner* — Igor Kershteyn

(74) *Attorney, Agent, or Firm* — Carlson, Gaskey & Olds PC

(57) ABSTRACT

The ends of cooling air passages in turbine blades and/or vanes of a gas turbine engine are provided with turbulation promoters to enhance the cooling of such structures as inner and outer shrouds and the like to accommodate thermal loads thereon.

29 Claims, 5 Drawing Sheets

ENHANCED TURBINE AIRFOIL COOLING

BACKGROUND OF INVENTION

1. Technical Field

This invention relates to the internal cooling of gas turbine engine, turbine airfoils and particularly the end portions thereof.

2. Background Art

Modern gas turbine engines operate at temperatures approaching 3000° F. Accordingly, it is a common practice to cool various components employed in such engines with air provided by the engine's compressor. Perhaps the most critical components to cool with compressor air are the first stage turbine blades and vanes which are exposed to products of combustion exiting the engine's combustor.

It is well known to provide such compressor discharge cooling air to first stage turbine blades and vanes by routing such air through passages internally of the airfoil portions thereof. Such passages may be cast into the airfoil portions or drilled into the blades or vanes by mechanical or electrochemical machining processes.

In the case of turbine blades and vanes for large industrial gas turbine engines, it is a common practice to employ shaped tube electrochemical machining to form cooling air passages which extend radially from the inner end of the airfoil to the outer end thereof. For enhanced convective cooling, the cooling air passages often include discontinuities in the walls thereof to enhance the turbulence of the flow of cooling air through the passages by eliminating the boundary layer of airflow along the passage walls. Such discontinuities, often referred to as turbulence promoters or turbulators, may take the form of grooves or ridges in the cooling passage walls.

While such turbulators enhance the convective cooling of the interiors of turbine blades and vanes, they necessarily increase the losses associated with the flow of cooling air through the passages and thus adversely affect the overall efficiency of the engine. Therefore, it has been the conventional wisdom to use such turbulators only where they are most necessary from the standpoint of thermal loading. It is generally accepted in the prior art that the locations where internal cooling of turbine blades and vanes is most critical (where thermal loads are greatest) are those locations in the blade or vane airfoils intermediate the root and tip portions thereof. Accordingly, as a result of qualitative analyses of the operating characteristics of blades and vanes, it has been the practice to provide such turbulators only in the intermediate portions of the internal cooling passages of turbine blades and vanes, the root and tip ends of the passages being smooth to minimize the inefficiencies associated with the creation of turbulent flow therein.

However, inspections of modern industrial gas turbine engines, as part of the routine overhaul and maintenance thereof, has revealed that the blades and vanes of such engines experience significant and often unanticipated thermal stress at the ends thereof as evidenced by, for example, cracking in the blade shrouds, such as, in the fillet where the shroud joins the blade. Several solutions to such thermal stress and damage to the blade have been proposed and typically involve a rather complex distribution of additional cooling passages and chambers in the shroud. While such cooling schemes have met with limited success, they greatly increase the complexity of the internal cooling passage configuration and thus greatly increase the complexity and manufacturing costs of the blade. These increased costs may more than offset the savings in operating costs associated with having smooth bores at the radially inner and outer ends of the airfoil cooling passages.

DISCLOSURE OF INVENTION

The present invention is predicated on the recognition that the qualitative analyses which led to the implementation of turbulators only in the intermediate portions of blade and vane radial cooling passages may have failed to take into account factors which would cause destructive thermal loading at the end portions of the blades and vanes, for example, at blade shrouds through which the unturbulated portions of the cooling passages extend.

One factor which would give rise to destructive thermal loading of the blade and vane end portions is a reduced total airflow through the cooling passages due to anomalies in the cooling air flow circuit beginning with the gas turbine engine's compressor and terminating with the blade or vane itself. Such anomalies include, for example, partial blockage of the flow passages with foreign matter, anomalies in the operation of the engine's compressor, wear of rotating seal components etc.

Another factor which theoretically can cause destructive thermal loading of blade and vane end portions is a deviation from a normal (uniform) temperature profile at the exit of the engine's combustor. Typically, gas turbine engine combustors are designed to provide combustion gases at a generally uniform temperature profile across the flow path of the engine's products of combustion. Foreign matter or pollutants in the engine's fuel system can cause blockage of some of the full nozzles in the combustor, resulting in asymmetries in the temperature profile across the combustor exhaust, thereby resulting in hot spots in the vanes and nozzles. Moreover, when replacement vanes and blades are employed in engines with unknown nominal operating parameters such as combustion exhaust temperature profiles, it would most efficacious to provide such blades with sufficient turbulation at the ends of the cooling passages to accommodate any anomalies in engine operation such as unevenness in the temperature profile at the combustor exhaust.

Recognizing that the heretofore common practice of providing turbulation only at the intermediate or medial portion of blade and vane cooling passages may not provide adequate convective cooling of gas turbine engine blades and vanes, in accordance with the present invention, turbulence promoters are provided in such blades and vanes at the radial extremities thereof. In a preferred embodiment of the present invention, in a turbine blade having radial cooling holes substantially along the entire length thereof, turbulence promoters are provided all the way to the tip of the blade including through any outer shroud thereof. The turbulence promoters may take on any of various known shapes such as annular or partially annular ribs or grooves.

In accordance with another aspect of the present invention, the thermal performance of prior art blades and vanes may be improved upon by adding turbulation promoters to the smooth walled portions of radial cooling channels, thereby restructuring such channels to increase the turbulent flow and thus the convective cooling provided in such smooth walled portions to accommodate the unanticipated destructive thermal loading outlined above.

It has been determined that perhaps counterintuitively, adding such turbulation promoters to such smooth walled portions of the cooling channels does not unacceptably lower the operating efficiency of the associated engine nor does it appreciably increase the manufacturing costs of the blades and vanes since fully turbulated holes may be formed without undue attention to the depth of placement of the tooling which forms the turbulators at the beginning and conclusion of the turbulator forming process.

Finally, it is believed that at least in the case of the provision of turbulators in the radially outer ends of shrouded turbine airfoils, the enhanced convective cooling of the shroud by a resultant turbulent cooling may reduce the need for stress reducing structures such as fillets and the like, thereby minimizing the size and weight of such structures as well as reducing the need for added cooling holes, passages and other fluid handling structural intricacies in the shroud and, in general, increase the overall mechanical and thermal capacity of such blades.

BEST MODE FOR CARRYING OUT THE INVENTION

Figure 1:
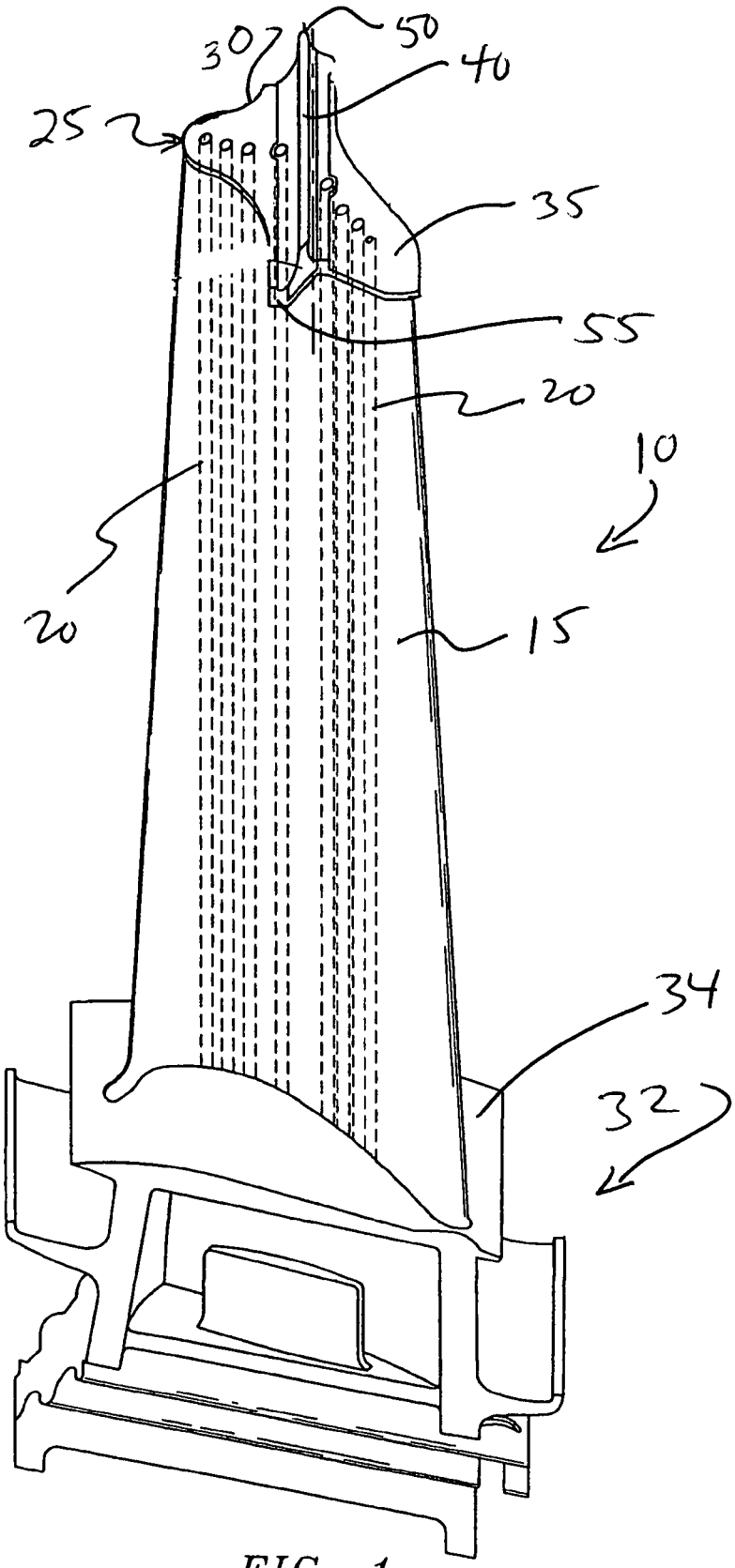
FIG. 1 is an isometric view of a turbine blade in accordance with the present invention.
Figure 2:
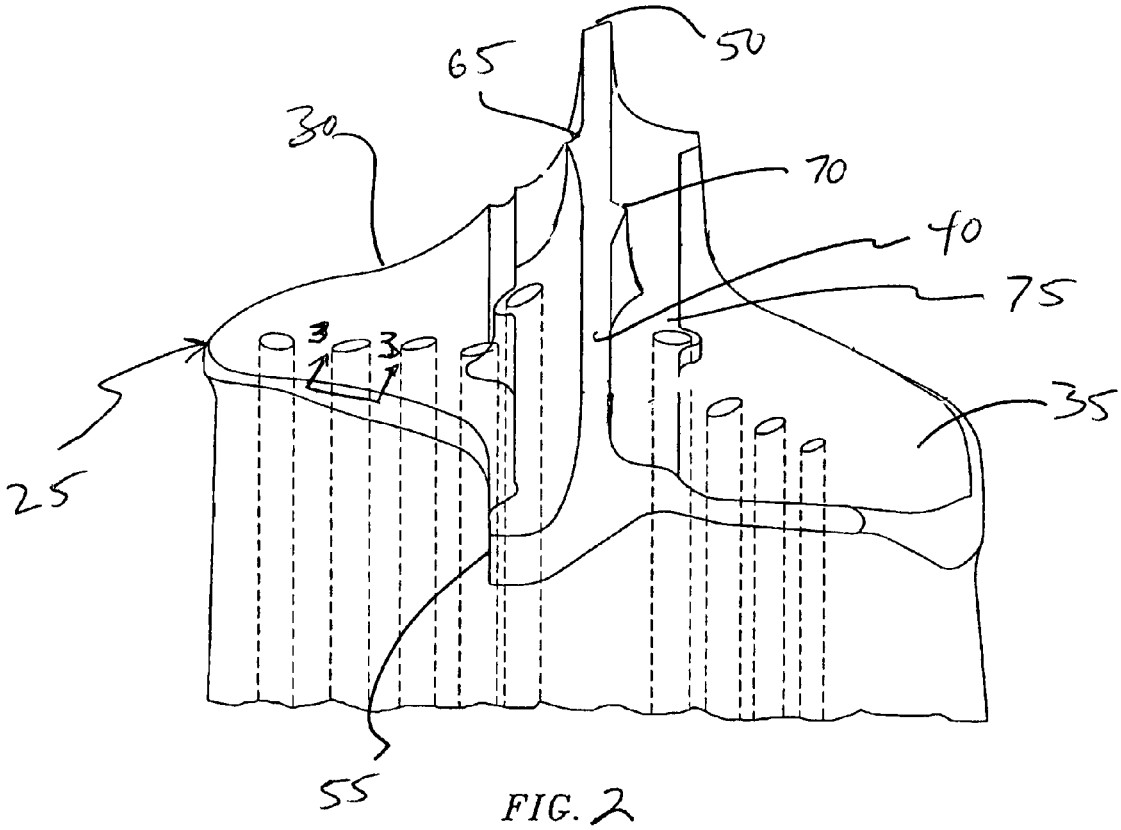
FIG. 2 is an enlargement of a tip of the blade of FIG. 1, including a tip shroud thereon.

Referring to the drawings, FIG. 1 and FIG. 2 illustrate a turbine blade 10 for use in a gas turbine engine. The turbine blade 10 has an airfoil portion 15 which typically contains a plurality of radially extending internal cooling passages 20. The airfoil portion 15 has a tip end 25 to which an outer shroud 30 is integrally formed typically by casting or attached as a separate component. The shroud 30 is shaped to mate with like shrouds on adjacent turbine blades so as to lend rigidity to the radially outer portion of a circumferential array of such blades and prevent combustion gases from leaking around the turbine blade 10. Similarly, blade 10 has a root end 32 including inner shroud or platform 34 which typically mates with platforms on adjacent blades for mechanical integrity of the blade array and to prevent products of combustion from leaking around airfoil portion 15.

As can be seen in FIG. 1, the shroud 30 has a major outer surface 35 on which a knife edge 40 is attached. The knife edge 40 is substantially linear in shape and intersects the chord line of the airfoil portion 15 at an angle. The knife edge 40 may have any desired width and/or height and terminates in ends 50 and 55, and in a manner well known in the art, mates with a groove in radially adjacent honeycomb stator (not shown) material to provide a rotating seal which helps in preventing working fluid from leaking around the blade tips.

Figure 3:
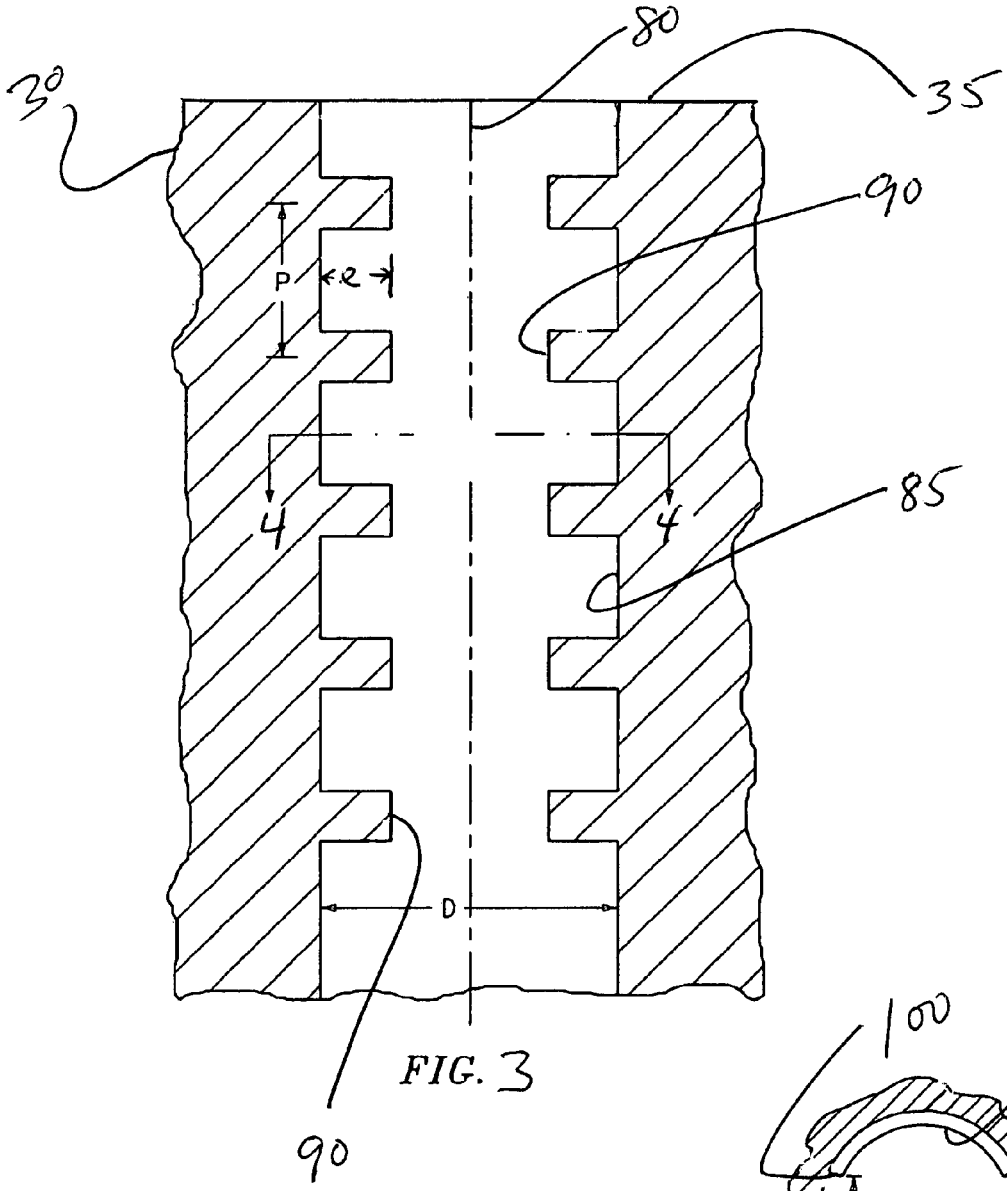
FIG. 3 is an enlarged sectional view of one of the cooling passages in the blade's shroud, taken in the direction of line 3-3 in FIG. 2.

Referring to FIGS. 2 and 3, the knife edge 40 has a central region 60 which is spaced from the ends 50 and 55. In this central region 60, a pair of cutter blades 65 and 70 are formed by machining out portions of the knife edge 40. Cutter blades 68 and 70 cut the above-mentioned groove in the stator honeycomb as the knife edge rubs thereagainst upon engine start-up. As can be seen in FIGS. 1 and 2, machining of the cutter blades 65 and 70 results in the knife edge 40 having a base portion 75 which is wider than the radially outer edge of the knife edge 40.

Still referring to FIGS. 1 and 2, each of the internal cooling passages 20 extends through the blade 10 over its entire length, including from root end including platform 34 to the tip end 25 including outer shroud 30. Typically, the turbine blade 10 has a plurality of such cooling passages 20. Each of the cooling passages exits at the outer surface of shroud 30 either at the major portion 35 of the outer surface thereof or the base portion 75 of knife edge 40. Each of the cooling passages 20 conducts a cooling fluid, i.e., air, from a radially inner inlet in communication with a source the air, such as compressor bleed air, throughout its entire length for purposes of cooling the blade.

Turbine blade 10 may be formed from any suitable material known in the art such as a nickel based superalloy. To improve the cooling characteristics of the turbine blade 10, each of the cooling passages 20 has a plurality of turbulation promoters (turbulators) disposed therealong, not only within airfoil portion 15, but also along the radially inner and outer portion thereof, within shrouds 30 and 34.

Figure 4:
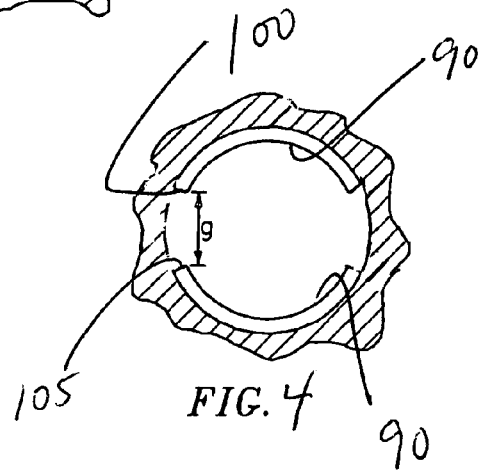
FIG. 4 is a sectional view of the cooling passage of FIG. 3 taken in the direction of line 4-4 thereof.

Referring now to FIGS. 3 and 4, there is shown a first embodiment of a cooling passage 20 which has a circular cross section. The cooling passage 20 extends along an axis 80 from the root end to the tip end of the blade and comprises a wall 85. The wall 85 defines a passage (having a diameter D) for the cooling fluid.

A plurality of turbulation promoters (turbulators) 90 are incorporated into the passage 20. The turbulation promoters may comprise arcuately shaped trip strips which have a height e and which circumscribe an arc of less than 180 degrees. The ratio of e/D is preferably in the range of from 0.05 to 0.30. Trip strips 95 may be annular or take the form of spaced arcuate members (see FIG. 4) having an angular span of less than 180 degrees with end portions 100 and 105 spaced apart by a gap g. The gaps g may be in the range of e to 4e or from 0.015 inches to 0.050 inches. The gaps g are preferably oriented away from the maximum heat load.

As can also be seen from FIG. 3, a plurality of pairs of trip strips 95 are positioned along the axis 80. The pairs of trip strips 95 are separated by a pitch P, the distance between mid-points of adjacent trip strips 95. In a preferred embodiment of the present invention, the ratio of P/e is in the range of from 5 to 30.

The pairs of trip strips 95 are preferably aligned so that the gaps g of one pair of trip strips 95 is aligned with the gaps g of adjacent pairs of trip strips 95. It has been found that such an arrangement is desirable from the standpoint of creating turbulence in the flow in the passageway 20 and minimizing the pressure drop of the flow.

Figure 5:
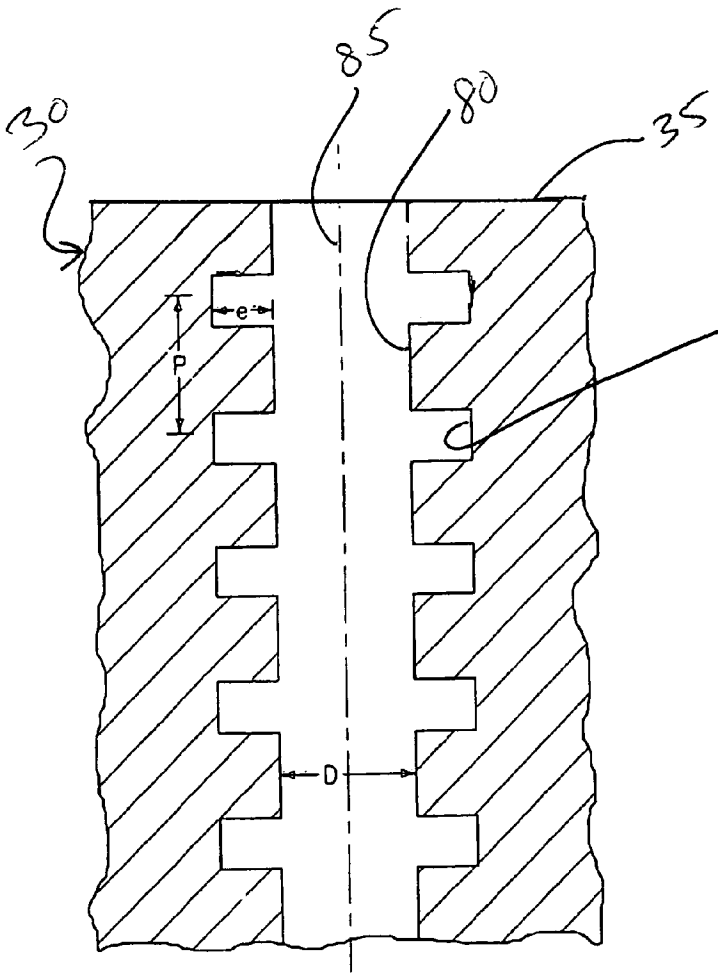
FIG. 5 is an enlarged sectional view of a first alternate embodiment of the cooling passage shown in FIG. 3.

Referring now to FIG. 5, instead of trip strips formed on the wall 80, the turbulation promoters 95 may comprise notches 115 cut into the wall 80 by any suitable process such as electrochemical machining as noted above. As is the case with respect to the embodiment of FIGS. 3 and 4, each of the notches 115 may be arcuate in shape and may circumscribe an arc of less than 180 degrees. Still further, the notches may have a ratio of e/D which is in the range of from 0.05 to 0.30 and may have a surface 120 which is normal to the axis 85 and the flow of the cooling fluid through the passageway 14. The ratio of P/e is preferably in the range of from 5 to 30.

Figure 6:
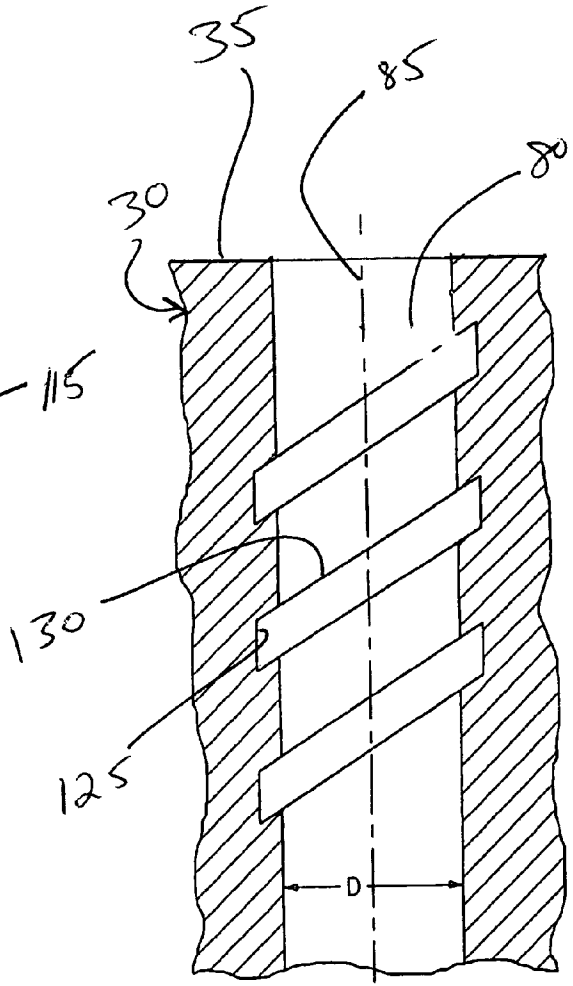
FIG. 6 is an enlarged sectional view of a second alternate embodiment of the cooling passage shown in FIG. 3.

Referring now to FIG. 6, there is shown an alternative embodiment of a cooling passageway 14 having turbulation promoters 125 which have a surface 130 which is at an angle a in the range of 30 degrees to 70 degrees, such as 45 degrees, with respect to the axis 85 and the flow of the cooling fluid through the passage 20. The turbulation promoters may be either trip strips on the wall 80 or notches in the wall. As before, the turbulation promoters 125 are preferably arcuate in shape and circumscribe an arc less than 180 degrees. The turbulation promoters 125 may be aligned pairs of which have end portions spaced apart by a gap and each pair may be offset along the axis 85 as shown in FIG. 4. This has the benefit of a reduced pressure drop for an equivalent heat transfer level. Here again, the ratio P/e may be in the range of from 5 to 30. Alternately, the turbulation promoters may comprise a continuous helix.

Figure 7:
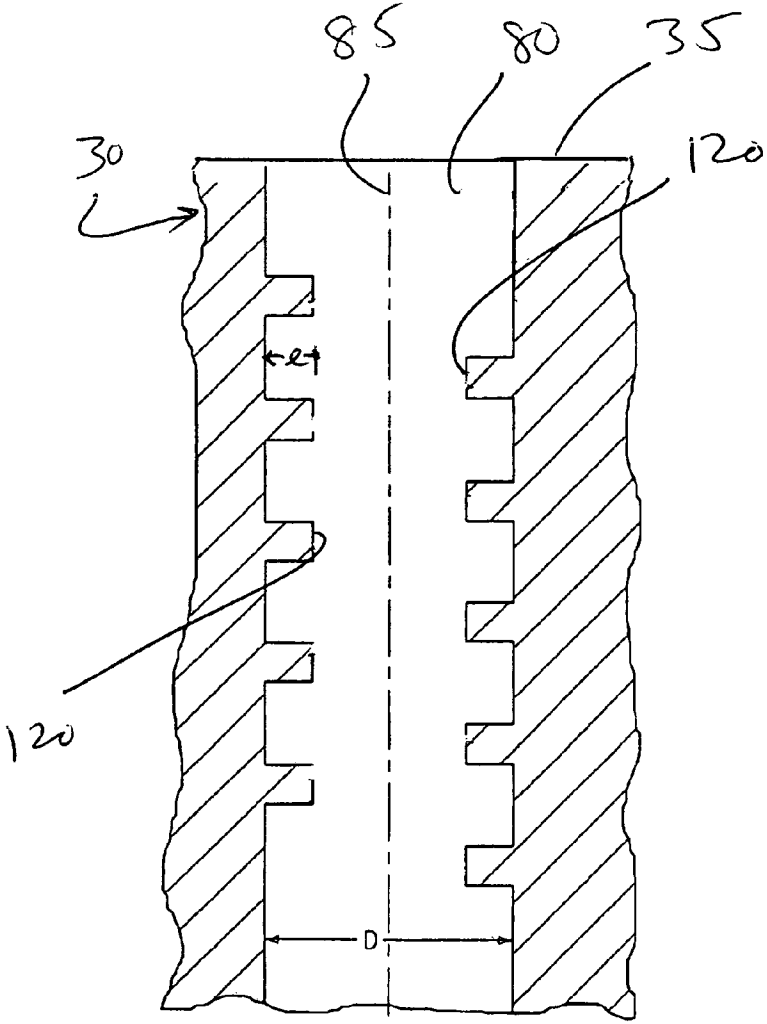
FIG. 7 is an enlarged sectional view of a third alternate embodiment of the cooling passage shown in FIG. 3.

Referring now to FIG. 7, another embodiment of a cooling passage 20 is illustrated. In this embodiment, the turbulation promoters include a first set of trip strips 130 and a second set of trip strips 135 offset from the first set of trip strips. The trip strips 130 and 135 are both arcuate in shape and circumscribe an arc of less than 180 degrees. As before, the trip strips 130 and 135 have a ratio of e/D in the range of from 0.05 to 0.30. The ratio P/e for each of the sets is preferably in the range of from 5 to 30.

Figure 8:
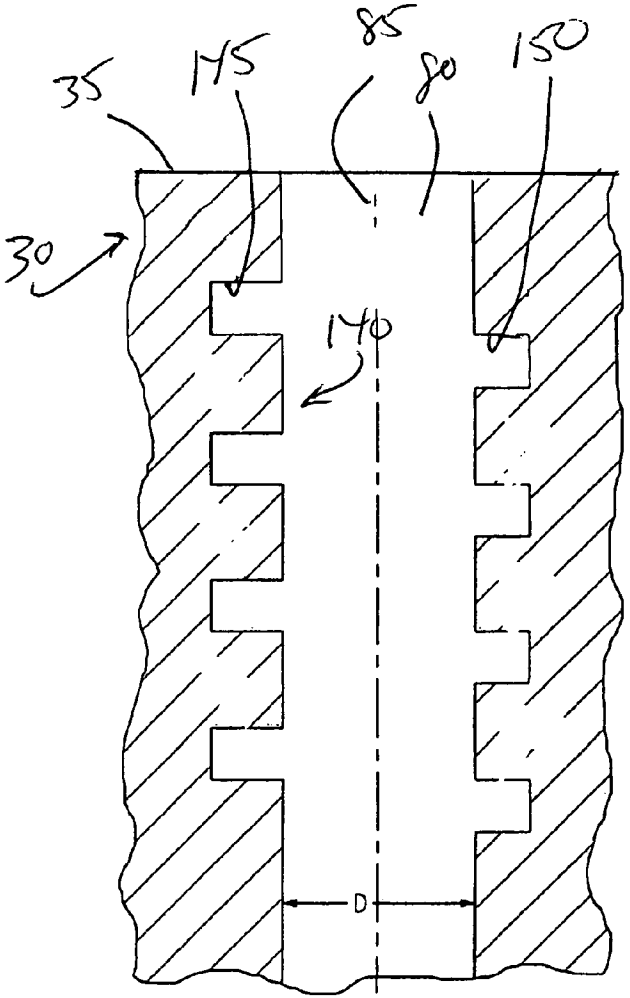
FIG. 8 is an enlarged sectional view of a fourth alternate embodiment of the cooling passage shown in FIG. 3.

Referring now to FIG. 8, there is shown still another embodiment of a cooling passage 20 having offset turbulation promotion devices 140. The offset turbulation devices 80 take the form of a first set of notches 145 and a second set of offset notches 150. Each of the notches 145 and 150 is arcuate in shape and circumscribes an arc less than 180 degrees and may have a ratio of e/D in the range of from 0.05 to 0.30. In this embodiment, as in the others, the ratio P/e for each set of notches is in the range of 5 to 30.

As set forth hereinabove, the cooling passages shown in FIGS. 3-8 may be formed using any suitable technique know in the art. In a preferred embodiment of the present invention, the cooling passages 14 with the various turbulation promoters are formed using an electrochemical drilling technique.

While the turbulence promoters are shown and described herein as acute in shape and circumscribing somewhat less than 180 degrees, it will be understood that fully annular turbulence promoters or turbulence promoters of any of various other known shapes such as full or partial helices may be employed with equal efficacy and may be formed by methods other than the aforementioned electrochemical machining operation, such as ordinary mechanical drilling and tapping methods.

Also, while the present invention as shown and described within the context of a blade or vane manufactured in accordance with the present invention, the present invention is equally applicable in the improvement of prior art blades or vanes wherein only the intermediate portions of the cooling air passages are turbulated. In such cases, the smooth bore portions of the cooling air passages may be machined by any of the methods mentioned hereinabove to add turbulence promoters thereto, resulting in the advantages and benefits discussed hereinabove.

Furthermore, while the invention herein has been described in connection with the outer shroud of a gas turbine engine turbine blade, it will be understood that this invention is equally applicable to inner turbine blade shrouds as well as inner or outer vane platforms and shrouds.

Therefore, it will be appreciated that various embodiments and applications of the present invention beyond those specifically discussed and illustrated herein are contemplated and it is intended by the appended claims to cover such embodiments and applications as full within the true spirit and scope of this invention.

The invention claimed is:

1. A turbine airfoil for a gas turbine engine said turbine airfoil having an end and including a plurality of generally radially extending cooling passages therein, at least one of said cooling passages terminating at said end of said airfoil and including turbulence promoters therewithin, said turbulence promoters extending substantially completely to said end of said airfoil and wherein said end includes an outer shroud and said at least one of said cooling passages and said turbulence promoters terminates at an outer surface of said shroud.

2. The turbine airfoil of claim 1 wherein said airfoil comprises a blade.

3. The turbine airfoil of claim 1 wherein said airfoil comprises a vane.

4. The turbine airfoil of claim 1 wherein said at least one cooling passage is defined by a wall, said turbulence promoters comprising a plurality of axially spaced lands extending inwardly toward the center of said passage from said wall.

5. The turbine airfoil of claim 4 wherein each of said lands is generally annular.

6. The turbine airfoil of claim 5 wherein each of said generally annular lands circumscribe an arc of slightly less than 180 degrees.

7. The turbine airfoil of claim 1 wherein said at least one cooling passage is bounded by a wall and said turbulence promoters comprise a plurality of axially spaced annular recesses disposed in said wall.

8. The turbine airfoil of claim 1 wherein said at least one cooling passage is defined by a wall, said turbulence promoters comprising a plurality of axially spaced recesses in said wall.

9. The turbine airfoil of claim 8 wherein said recesses are helical.

10. The turbine blade of claim 1 wherein said shroud includes a knife edge seal extending longitudinally in the direction of blade rotation, said knife edge seal including a base portion along which said knife edge seal attaches to a radially outer, major surface of said shroud, said at least one cooling passage extending through said base portion of said knife edge seal and terminating at an outer surface thereof.

11. The turbine blade of claim 1 wherein said at least one cooling passage is bounded by a wall, and said turbulence promoters comprise a plurality of radially spaced lands extending inwardly, toward the center of said passage from said wall.

12. The turbine blade of claim 11 wherein said lands are disposed along the interior of said cooling passage in a generally helical arrangement.

13. The turbine blade of claim 11 wherein each of said lands is generally annular.

14. The turbine blade of claim 13 wherein each of said generally annular lands circumscribes an arc of slightly less than 180 degrees.

15. A turbine blade comprising an airfoil portion terminating at a radially outer portion thereof at a tip shroud, said airfoil portion including at least one radially extending cooling passage, terminating at an outer surface of said tip shroud, said at least one radially extending cooling passage including turbulence promoters distributed along at least a portion of the length of said at least one passage and to said termination of said end thereof at said tip shroud.

16. The turbine blade of claim 15 wherein said tip shroud includes a knife edge seal thereon having a base portion at which said knife edge seal attaches to a radially outer, major surface of said shroud, said at least one cooling passage extending through said base portion of said knife edge seal.

17. The turbine blade of claim 15 wherein said airfoil portion includes additional, radially extending cooling passages terminating at a radially outer major surface of said tip shroud.

18. The turbine blade of claim 15 wherein said turbulence promoters comprise a plurality of radially spaced lands extending inwardly, toward the center of said passage, from a sidewall thereof.

19. The turbine blade of claim 18 wherein said lands are generally annular in shape.

20. The turbine blade of claim 19 wherein at least a portion of said annular lands subscribe an arc of slightly less than 180 degrees.

21. The turbine blade of claim 15 wherein said turbulence promoters are distributed along substantially along the entire length of said radially extending cooling passage.

22. The turbine blade of claim 15 wherein said turbulence promoters are distributed along the interior of said at least one cooling passage in a generally helical distribution.

23. A method of enhancing the internal convective cooling of an end portion of a turbine airfoil having a tip shroud and at least one internal cooling passage which terminates at said end portion of said turbine airfoil and said tip shroud and is provided with turbulence promoters therewithin along a medial portion to a tip portion thereof, said method comprising the steps of:

determining the location of the radially endmost of said turbulence promoters and said tip shroud;

inserting a cutting tool into said at least one passage from end portion of said airfoil and said tip shroud and machining turbulence promoters into said at least one passage from said termination of said cooling passage to said radially endmost turbulence promoter.

24. The method of claim 23 wherein said machining of said turbulence promoters and said tip shroud comprises electrochemical machining.

25. The method of claim 23 wherein said shroud comprises a radially outer shroud and said at least one cooling passage terminates at a radial outer major surface of said radially outer shroud.

26. The method of claim 23 wherein said turbulence promoters machined in said at least one cooling passage comprise a plurality of radially spaced annular recesses.

27. The method of claim 26 wherein said radially spaced recesses are separated by generally annular lands.

28. The method of claim 27 wherein said generally annular lands circumscribe arcs of slightly less than 180°.

29. The method of claim 23 wherein said machining of said turbulence promoters comprises forming helical lands in said passage.

* * * * *